US010323818B2

(12) United States Patent
Salter et al.

(10) Patent No.: US 10,323,818 B2
(45) Date of Patent: Jun. 18, 2019

(54) VEHICLE LIGHT ASSEMBLY HAVING MOISTURE SENSING AND HEATING

(71) Applicant: Ford Global Technologies, LLC, Dearborn, MI (US)

(72) Inventors: Stuart C. Salter, White Lake, MI (US); Paul Kenneth Dellock, Northville, MI (US); Stephen Kenneth Helwig, Farmington Hills, MI (US); Aaron Bradley Johnson, Allen Park, MI (US); Pietro Buttolo, Dearborn Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/586,650

(22) Filed: May 4, 2017

(65) Prior Publication Data

US 2018/0320854 A1 Nov. 8, 2018

(51) Int. Cl.

| | |
|---|---|
| ***F21V 23/04*** | (2006.01) |
| ***F21V 29/90*** | (2015.01) |
| ***F21S 45/33*** | (2018.01) |
| ***F21S 45/37*** | (2018.01) |
| ***F21S 45/60*** | (2018.01) |
| ***F21S 41/20*** | (2018.01) |

(52) U.S. Cl.

CPC ..... *F21S 45/33* (2018.01); *F21S 41/28* (2018.01); *F21S 45/37* (2018.01); *F21S 45/60* (2018.01)

(58) Field of Classification Search

CPC . F21V 29/90; F21S 45/37; F21S 45/33; F21S 45/60; H05B 1/0236; H05B 3/0042; H05B 2203/031

See application file for complete search history.

(56) References Cited

U.S. PATENT DOCUMENTS

| | | | | |
|---|---|---|---|---|
| 4,410,843 | A * | 10/1983 | Sauer | B60J 1/17 219/203 |
| 7,629,558 | B2 | 12/2009 | Petrenko | |
| 9,371,032 | B2 | 6/2016 | Veerasamy | |
| 2004/0149734 | A1* | 8/2004 | Petrenko | B60S 1/026 219/538 |
| 2007/0007284 | A1* | 1/2007 | Veerasamy | H05B 3/84 219/772 |
| 2013/0024169 | A1* | 1/2013 | Veerasamy | B32B 17/10036 703/2 |
| 2013/0114279 | A1* | 5/2013 | Marley | F21S 48/115 362/516 |
| 2016/0215952 | A1* | 7/2016 | Dunn | F21S 48/34 |
| 2018/0043862 | A1* | 2/2018 | Lesmeister | F21S 41/28 |

FOREIGN PATENT DOCUMENTS

| | | | |
|---|---|---|---|
| CN | 201298942 | Y | 8/2009 |
| DE | 202012005908 | U1 | 8/2012 |
| DE | 102012012014 | A1 | 1/2013 |
| FR | 2897321 | A1 | 2/2006 |
| KR | 20120050268 | A | 5/2012 |

* cited by examiner

*Primary Examiner* — Alexander K Garlen
*Assistant Examiner* — Eric T Eide
(74) *Attorney, Agent, or Firm* — Vichit Chea; Price Heneveld LLP

(57) ABSTRACT

A vehicle light assembly is provided that includes a light source, a lens in front of the light source, conductive circuitry provided on the lens and forming a capacitive sensor for sensing moisture on the lens and a heater for removing the moisture, and switching circuitry for selectively energizing one of the capacitive sensor and the heater.

19 Claims, 7 Drawing Sheets

VEHICLE LIGHT ASSEMBLY HAVING MOISTURE SENSING AND HEATING

FIELD OF THE INVENTION

The present invention generally relates to vehicle lighting, and more particularly relates to vehicle lighting assemblies that sense and reduce moisture.

BACKGROUND OF THE INVENTION

Automotive vehicles are commonly equipped with various exterior lighting assemblies including vehicle headlights at the front of the vehicle and taillights at the rear of the vehicle. Vehicle exterior lighting assemblies typically include a light source disposed within a housing having an outer lens. Some assemblies experience moisture buildup on the inside of the lens. In addition, moisture in the form of snow and ice may accumulate on the outside of the lens in cold weather conditions. It is generally known to provide defogger elements on the lens to evaporate the moisture that may be present on the lens. It may be desirable to provide for an enhanced lighting assembly that effectively senses moisture and reduces the moistures buildup on the lens.

SUMMARY OF THE INVENTION

According to one aspect of the present invention, a vehicle light assembly is provided. The vehicle light assembly includes a light source, a lens in front of the light source, and conductive circuitry provided on the lens and forming a capacitive sensor for sensing moisture on the lens and a heater for removing the moisture.

Embodiments of the first aspect of the invention can include any one or a combination of the following features:

- the conductive circuitry forming the capacitive sensor also serves as the heater;
- the light assembly includes switching circuitry for selectively switching operation of the conductive circuitry between the capacitive sensor and the heater;
- the light assembly includes a controller for controlling the switching circuitry to switch operation of the conductive circuitry between the capacitive sensor and the heater;
- the light assembly forms a vehicle headlight;
- the light assembly forms a vehicle rear taillight;
- the conductive circuitry comprises an optically transparent conductive material;
- the visually transparent conductive medium comprises indium tin oxide;
- the capacitive sensor comprises a first electrode comprising a first plurality of electrode fingers and a second electrode comprising a second plurality of electrode fingers, and wherein the first plurality of conductive fingers are interdigitated with the second plurality of conductive fingers;
- the heater operates as a resistive heater that generates heat based on electric current; and
- the conductive circuitry comprises at least one electrode that generates a capacitive signal for the capacitive sensor and generates heat for the heater.

According to another aspect of the present invention, a vehicle light assembly is provided. The vehicle light assembly includes a light source, a lens in front of the light source, and conductive circuitry provided on the lens and forming a capacitive sensor having at least one electrode for sensing moisture on the lens and a heater for removing the moisture.

The vehicle light assembly also includes switching circuitry for selectively energizing one of the capacitive sensor and the heater.

Embodiments of the second aspect of the invention can include any one or a combination of the following features:

- the light assembly includes a controller for controlling the switching to switch between the capacitive sensor and the heater;
- the light assembly forms a vehicle headlight;
- the light assembly forms a vehicle rear taillight;
- the conductive circuitry comprises an optically transparent conductive material;
- the capacitive sensor comprises a first electrode comprising a first plurality of electrode fingers and a second electrode comprising a second plurality of electrode fingers, wherein the first plurality of conductive fingers are interdigitated with the second plurality of conductive fingers;
- the heater operates as a resistive heater that generates heat based on electric current; and
- the at least one electrode forms the capacitive sensor and the heater.

According to yet another aspect of the present invention, a vehicle light assembly is provided. The vehicle light assembly includes a light source, a lens in front of the light source, and conductive circuitry provided on the lens and forming a capacitive sensor for sensing moisture on the lens and a heater for removing the moisture, wherein the conductive circuitry has at least one electrode that generates a capacitive signal in a sensing operation and generates heat in a heater operation. The vehicle light assembly also includes switching circuitry for selectively energizing one of the capacitive sensor and the heater.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
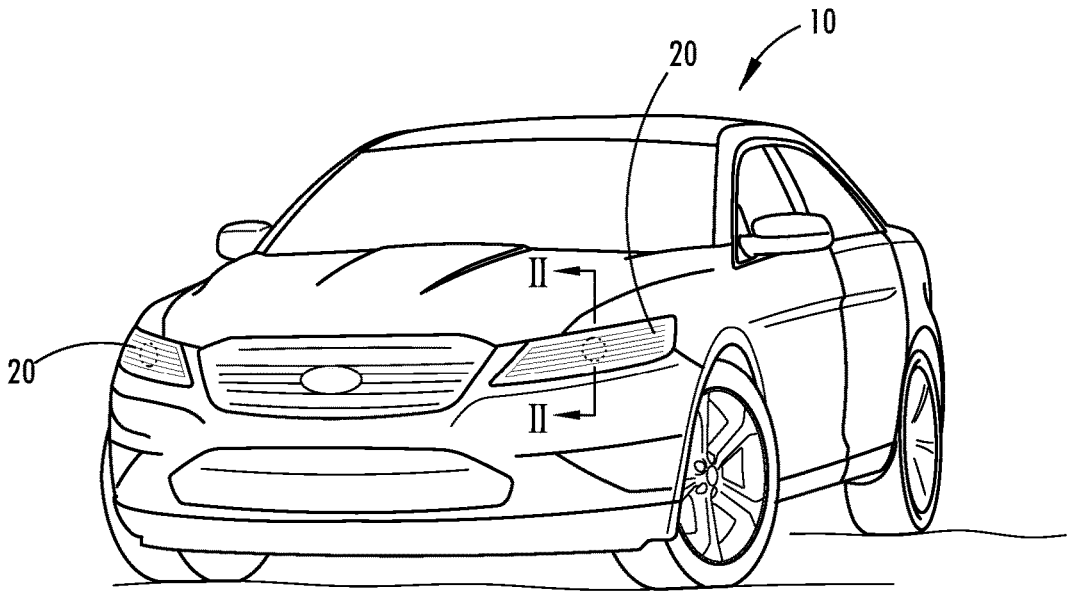
FIG. 1 is a front perspective view of a vehicle equipped with vehicle headlight assemblies having moisture sensing and removal, according to one embodiment.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1A:
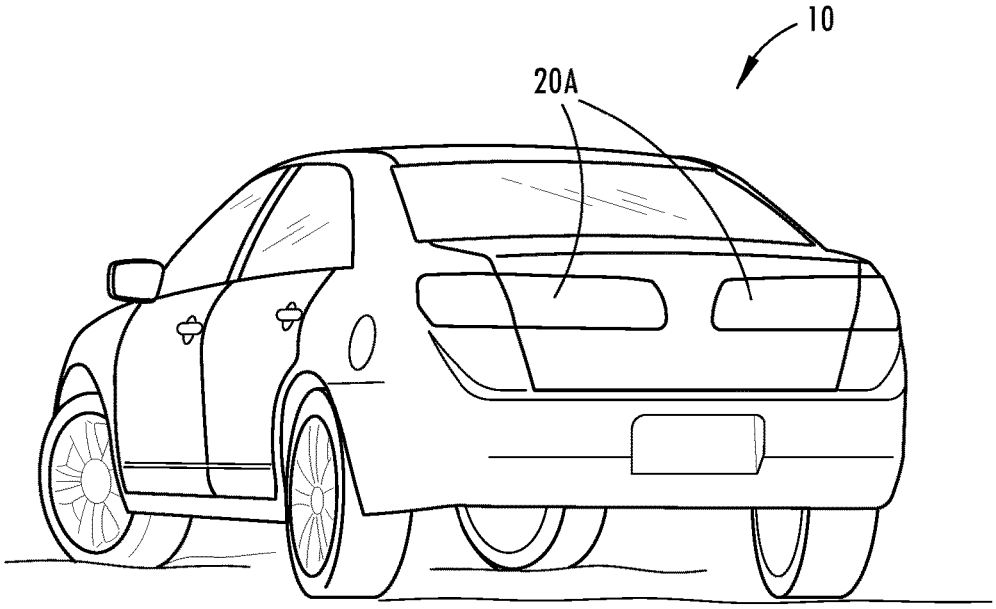
FIG. 1A is a rear perspective view of the vehicle having vehicle taillight assemblies that may include the moisture sensing and removal.

Referring to FIGS. 1-1A, a wheeled motor vehicle 10 is generally illustrated having moisture sensing and removal circuitry provided in the vehicle exterior light assemblies. The vehicle 10 is shown having a pair of vehicle headlight assemblies 20 located at the front left and right corners of the vehicle 10 for providing headlight illumination forward of the vehicle 10. The vehicle 10 is also shown having a pair of vehicle taillight assemblies 20A located at the rear left and right corners of the vehicle 10 for providing taillight illumination generally rearward of the vehicle. Each of the headlamp assemblies 20 and taillight assemblies 20A may be configured to include conductive circuitry that provides moisture sensing and removal of the moisture from the respective lighting assemblies. It should be appreciated that while each of the headlight assemblies 20 shown and described herein in detail has the conductive circuitry, the taillight assemblies 20A may likewise be configured to include the conductive circuitry for sensing and removing moisture.

Figure 2:
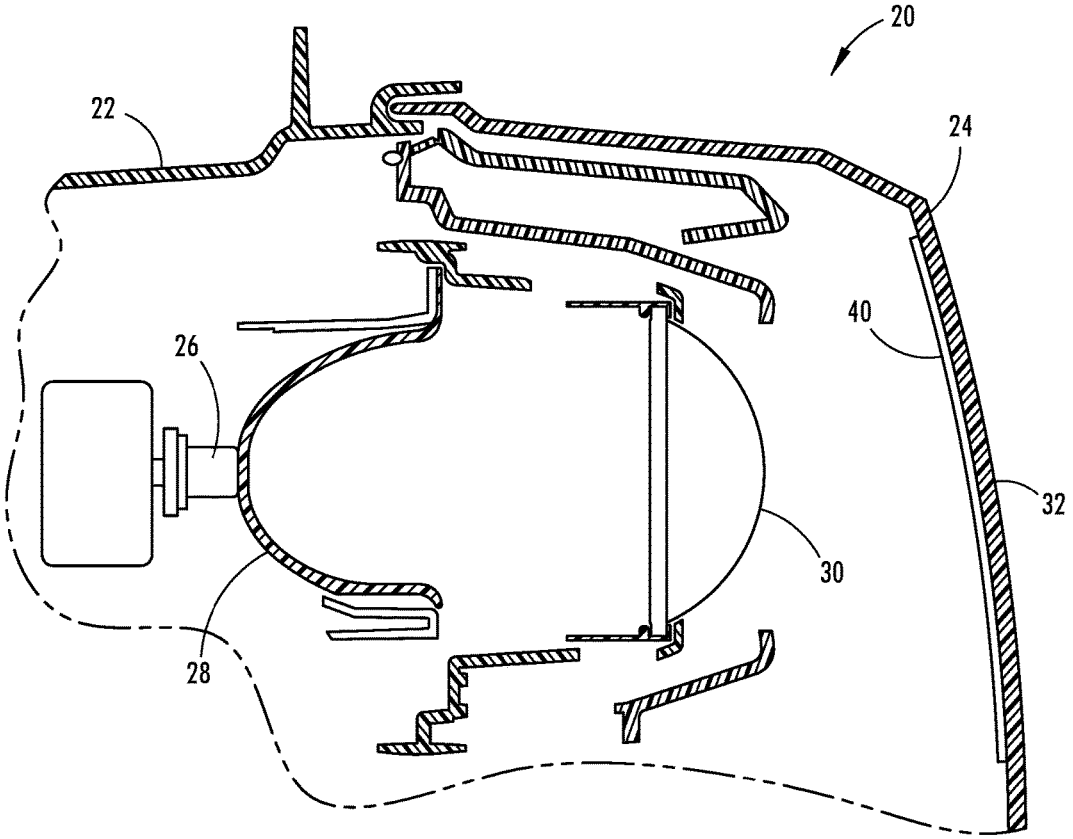
FIG. 2 is a cross-sectional view of one of the headlight assemblies taken through line II-II of FIG. 1.
Figure 3:
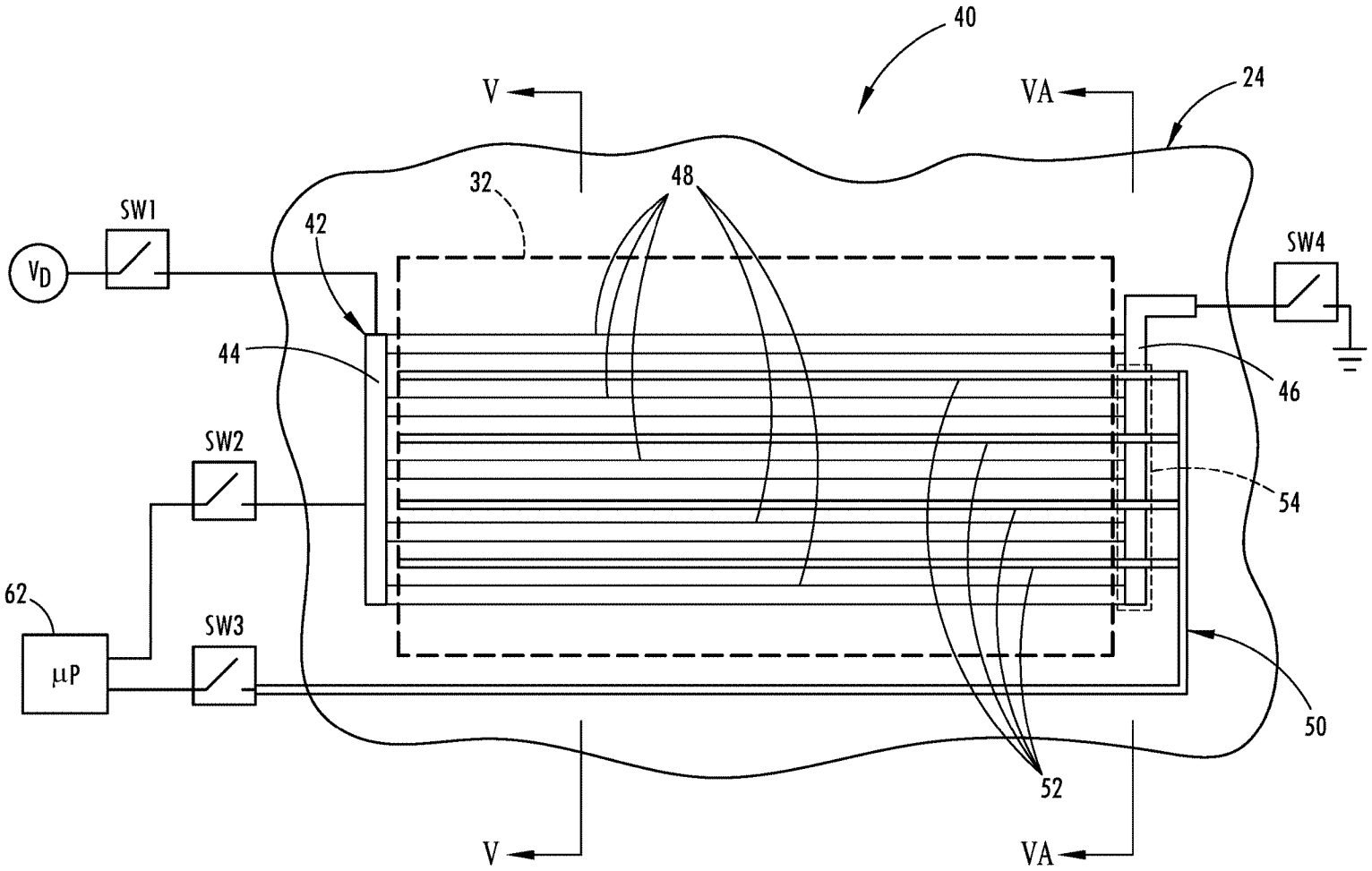
FIG. 3 is a schematic diagram of conductive circuitry formed on the lens for forming a capacitive sensor and heater and a control circuitry therefor.

Referring to FIG. 2, the vehicle headlight assembly 20 is shown having a housing 22 and an outer lens 24 connected to housing 22. Housing 22 is generally fixed to the vehicle body in a conventional manner. Disposed within the housing 22 and outer lens 24 is a light source 26, a reflector 28, and an inner lens 30. The light source 26 may include one or more light emitting diodes (LEDs), incandescent bulbs, halogen bulbs, or other sources of light illumination. The reflector 28 is generally positioned to reflect light output from the light source forward of the vehicle through the inner lens 30 and outer lens 24 to illuminate the roadway generally forward of the vehicle 10. The inner lens 30 and outer lens 24 may be made of a clear light transmissive polymeric material. The light assembly 20 may be configured as a low beam light assembly, a high beam light assembly, or a combination of low and high light beams assemblies. Additionally, the housing 22 and outer lens 24 may contain a plurality of light sources for multiple functions, such as headlight illumination, daylight running lamps, turn signals, flashers, and other lighting functions.

The vehicle light assembly 20 includes conductive circuitry 40 provided on the outer lens 24 for providing a capacitive sensor for moisture sensing and a heater for heating or defrost operations. The conductive circuitry 40 forms both a capacitive sensor for sensing moisture on the lens and a heater for removing the moisture. In the embodiment shown, the conductive circuitry 40 is formed on the inside surface of the outer lens 24. However, it should be appreciated that the conductive circuitry 40 may otherwise be formed on the outside surface of the outer lens 24 or in an intermediate layer of the outer lens 24, according to other embodiments.

The conductive circuitry 40 and control circuitry for controlling the conductive circuitry 40 is illustrated in FIGS. 3-5A. The conductive circuitry 40 is made up of an electrically conductive material that allows electrical current and signals to be transmit thereon. The conductive circuitry 40 includes a first electrode 42 having a first plurality of electrode fingers 48 shown extending between the conductive lines 44 and 46. The conductive circuitry 40 also includes a second electrode 50 having a second plurality of electrode fingers 52 that are electrically isolated or dielectrically isolated from the first plurality of electrode fingers 48. The first and second plurality of electrode fingers 48 and 52 are interdigitated so as to form a capacitive coupling therebetween when configured as a capacitive sensor. A dielectric layer 54 is disposed between electrode fingers 52 and connecting line 46 to allow the signal lines to cross over without making electrical connections. As such, the second electrode 50 and corresponding electrode fingers 52 are dielectrically isolated from connecting line 46 and the first electrode 42 and corresponding electrode fingers 48.

Switching circuitry including a plurality of switches, shown as first switch SW1, second switch SW2, third switch SW3, and fourth switch SW4 are illustrated connected to the conductive circuitry 40 to control switching of the conductive circuitry 40 between the capacitive sensor and heater operations. Each of the switches SW1-SW4 may be controlled by control circuitry including a microprocessor 62 as shown. The first switch SW1 connects the first electrode 42 via connecting line 44 to a defrost voltage source shown as $V_D$. The fourth switch SW4 is shown connecting the first electrode 42 via the connecting line 46 to ground. As such, when the first switch SW1 and fourth switch SW4 are in the closed positions for the heater operation, the defroster voltage $V_O$ is applied across the first electrode 42 from the first connecting line 44 across fingers 48 to the second connecting line 46 and to ground to cause electric current to flow therethrough and generate heat across the first electrode 42 to operate as a heater to defrost or defog the outer lens 24. At the same time, switches SW2 and SW3 are in the open position during the heater/defogger or defrost operation. It should be appreciated that electrical current passing through the first electrode 42 generates heat due to the electrical resistance of the circuit which forms a resistive heater for removing moisture from the outer lens 24. Moisture may be in the form of humidity which is water vapor in the air, or may be in the form of condensation which is water on a surface which can be in the form of liquid water or frozen water (e.g., ice or frost).

The conductive circuitry 40 may also be configured to operate in a sensing operation as a capacitive sensor to sense moisture on the outer lens 24 such as condensation on the inside or outside of the outer lens 24 or snow or ice on the outside of the outer lens 24. When moisture is sensed on the outer lens 24, the conductive circuitry 40 may be switched to the heater configuration to remove the sensed moisture. In order to operate as a capacitive sensor, the conductive circuitry 40 is controlled by opening the first switch SW1 and the fourth switch SW4 and closing the second switch SW2 and the third switch SW3. With the first and fourth switches SW1 and SW4 open, electrical power from the defrost voltage is removed and with the second and third switches SW2 and SW3 closed, the microprocessor 60 is able to control drive and receive signals to and from the first and second electrodes 42 and 50 so as to generate a capacitive activation field for sensing moisture on the outer lens 24. The capacitive sensor is configured to sense moisture, such as condensation on the interior surface of the outer lens 24 and humidity proximate to the interior surface of the lens 24 and water vapor on the outside of the lens 24 such as in the form of liquid or ice. The moisture is sensed by a change in the signal generated by the proximity sensor due to the moisture content in the air on the surface of the outer lens 24. When moisture is detected, the conductive circuitry may be switched to the heater operation to remove the moisture. It should be appreciated that the housing 22 or lens 24 may have a moisture outlet such as a Gore-Tex® patch to allow heated moisture to exit the interior.

The capacitive sensor employs the first electrode 42 as a drive electrode and the second electrode 50 as a receive electrode, each having interdigitated fingers 48 and 52, respectively, for generating a capacitive field. According to one embodiment, the first electrode 42 receives square wave drive signal pulses applied at a voltage. The second electrode 50 has an output for generating an output voltage. It should be appreciated that the first and second electrodes 42 and 50 and corresponding electrode fingers 48 and 52 may be arranged in various configurations for generating the capacitive fields as the sense activation fields, according to various embodiments. It should also be appreciated that the first and second electrodes 42 and 50 may otherwise be configured so that other types of single electrode sensors or other multiple electrode sensors may be used. The conductive circuitry 40 may be formed with conductive ink or may be alternatively be formed with rigid or flexible circuitry that may be adhered or otherwise attached to the outer lens 24.

According to one embodiment, the first electrode 42 is supplied with an input voltage as square wave signal pulses having a charge pulse cycle sufficient to charge the second electrode 50 to a desired voltage. The second electrode 50 thereby serves as a measurement electrode. When moisture, such as humidity or condensation on the interior or exterior surface of the outer lens 24 is detected, the moisture causes a disturbance in the activation field which generates a signal that is processed to determine the moisture level. The disturbance of the activation field is detected by processing the charge pulse signals.

The conductive circuitry 40 may be formed with a film of indium tin oxide (ITO). The ITO forming the conductive circuitry 40 may be formed as an ink printed onto the interior surface of the outer lens 24, according to one embodiment. The ITO may be deposited as a thin film onto the surface of the outer lens 24 and may have a thickness of about 1,000-3,000 angstroms to form a transparent electrical conductor. The ITO layer forming the conductive circuitry 40 is a substantially visually transparent medium that can be used to form the first and second electrodes 42 and 50 and other conductive signal lines for forming the proximity sensors and the heating elements. As such, the conductive circuitry 40 will remain substantially invisible to a user looking through the outer lens 24. In other embodiments, other transparent and semi-transparent or visible conductive inks or films may be used to form the conductive circuitry 40.

Figure 4:
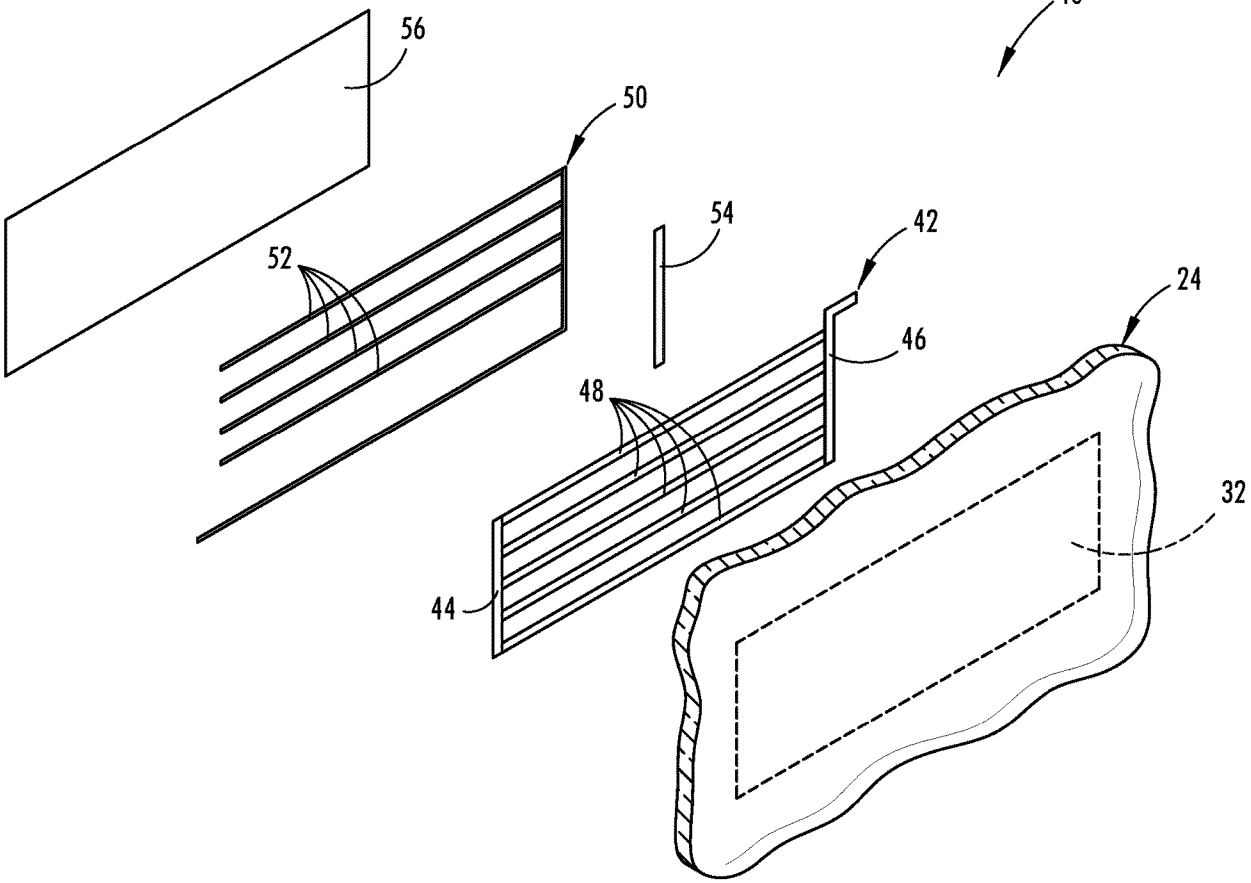
FIG. 4 is an exploded view of the conductive circuitry shown in FIG. 3.
Figure 5:
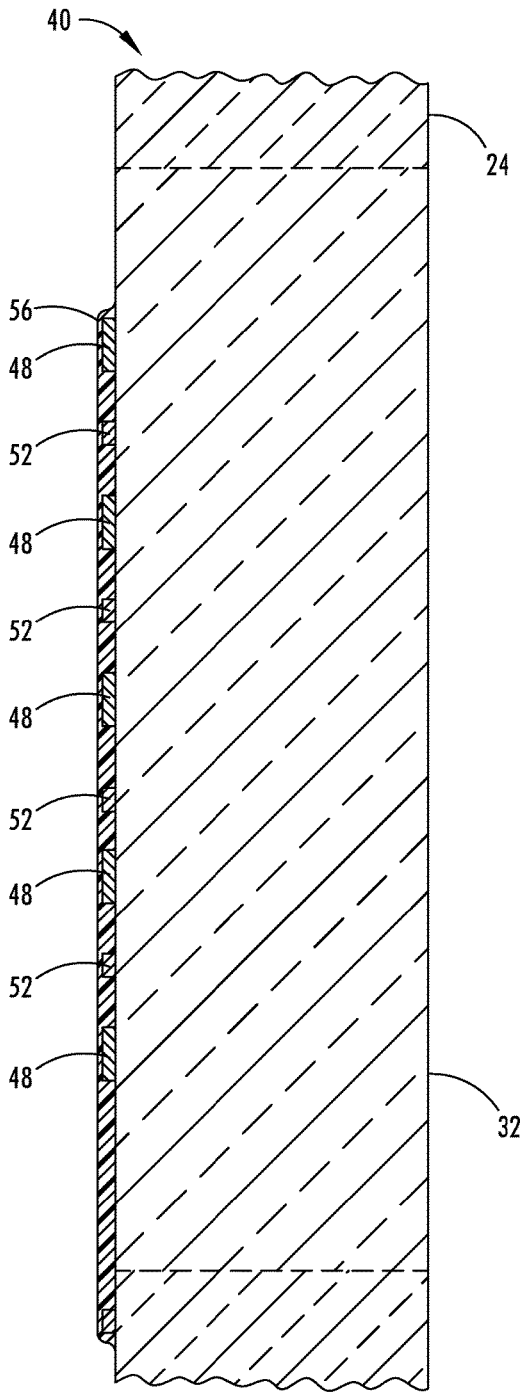
FIG. 5 is a cross-sectional view taken through line V-V of FIG. 3.
Figure 5A:
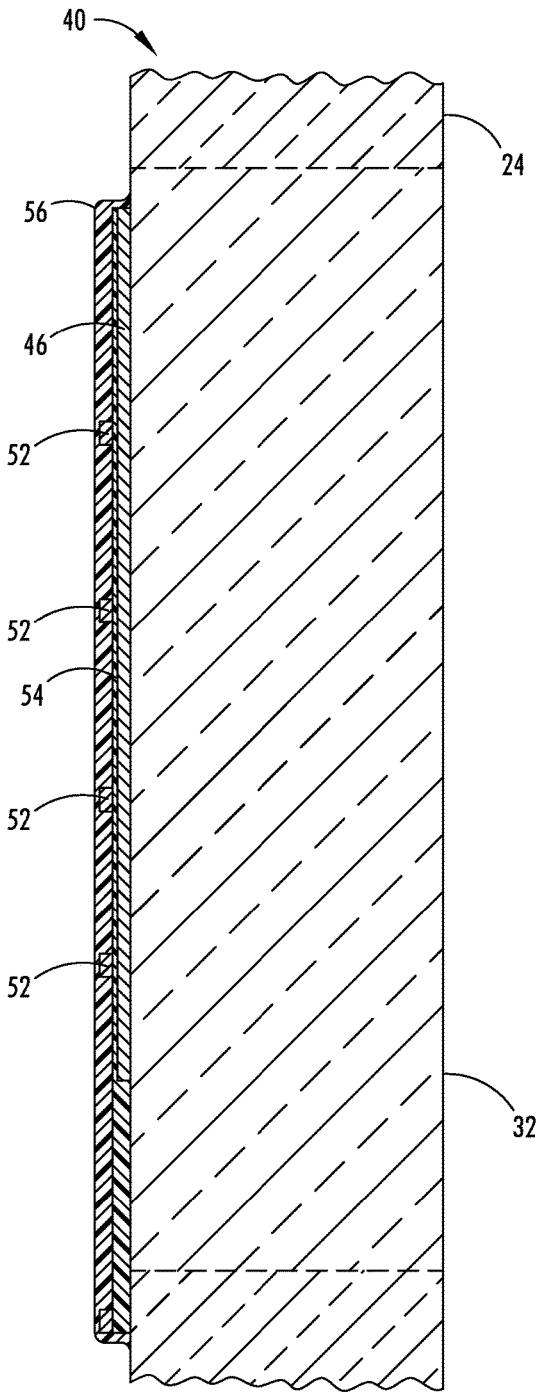
FIG. 5A is a cross-sectional view taken through line VA-VA of FIG. 3.

The first and second electrodes 42 and 50 and corresponding first and second plurality of conductive fingers 48 and 52, respectively, may be formed on the inside surface of the outer lens 24 as shown in FIGS. 4-5A. The first electrode 42 may be disposed on or adhered via an adhesive onto the inner surface of outer lens 24, according to one example. The second electrode 50 is also disposed onto the inner surface of outer lens 24 such that the second plurality of fingers 52 is interdigitated with the first plurality of fingers 48. In order to prevent short circuiting of the first and second electrodes 42 and 50, a dielectric layer 54 is disposed between the first and second electrodes 42 and 50 on the inner surface of connecting line 46 such that the second electrode 50 and second plurality of conductive fingers 52 are separated from the first electrode 42 at that location as shown in FIG. 5A. The remainder of the first and second electrodes 42 and 50 and conductive fingers 48 and 52 are substantially coplanar on the inner surface of the outer lens 24 as seen in FIG. 5. It should be appreciated that the dielectric layer 54 may be enlarged to cover substantially more or all of the surface area between the first and second electrodes, according to other embodiments.

Figure 6:
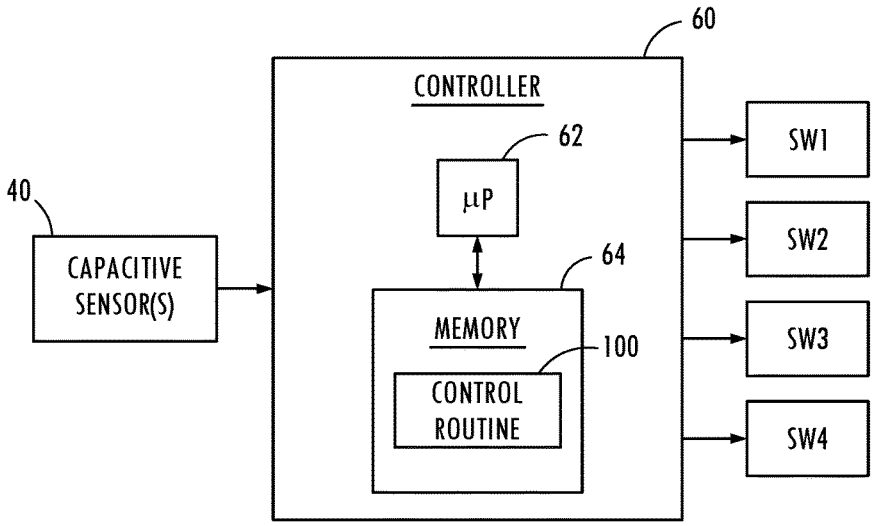
FIG. 6 is a block diagram illustrating controls for controlling the switching of the conductive circuitry.

Referring to FIG. 6, the conductive circuitry 40 is illustrated controlled by a controller 60, according to one embodiment. The capacitive sensor generated signals are input to the controller 60, such as a microcontroller. The controller 60 may include circuitry, such as a microprocessor 62 and memory 64. The control circuitry may include sense control circuitry for processing the activation field of the capacitive sensor to sense moisture proximate to the outer lens 24. It should be appreciated that other analog and/or digital control circuitry may be employed to process the capacitive field signals to determine the presence of moisture buildup on the outer lens 24 and initiate defogging or moisture removal with activation of the heater operation.

The controller 60 may include an analog-to-digital (A/D) comparator integrated within or coupled to the microprocessor 62 and may receive voltage output from the capacitive sensor, convert the analog signal to a digital signal, and provide a digital signal to the microprocessor 62. The controller 60 may include a pulse counter integrated within or coupled to the microprocessor 62 that counts the charge signal pulses that are applied to the drive electrode, performs a count of the pulses needed to charge the capacitor until the voltage output reaches a predetermined voltage, and provides the count to the microprocessor 62. The pulse count is indicative of the change in capacitance of the capacitive signal. The controller 60 may provide a pulse width modulated signal to a pulse width modulated drive buffer to generate the square wave pulse which is applied to the drive electrode. The controller 60 may determine the moisture present at or proximate to the outer lens 24 and control the heater by controlling the switches SW1-SW4 as outputs.

Figure 7:
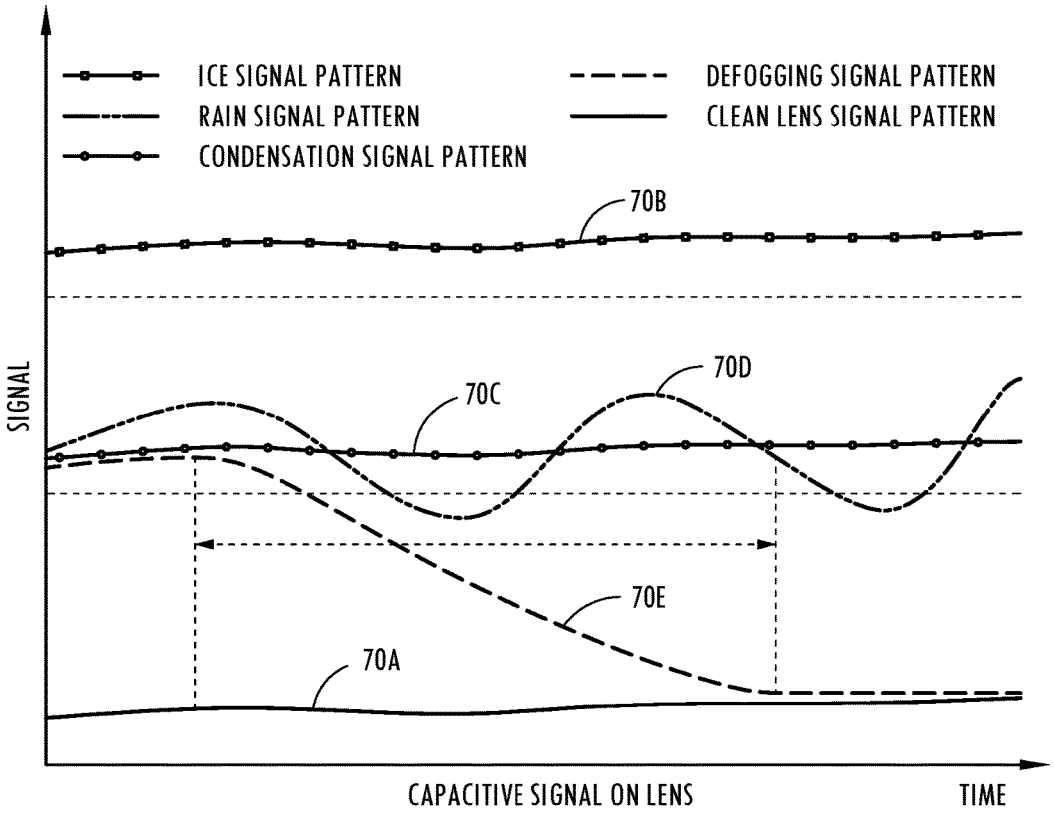
FIG. 7 is a graph illustrating signals generated by the capacitive sensor indicative of moisture on the lens.

Referring to FIG. 7, the change in signal charge pulse counts detected during various moisture conditions is shown as signals 70A-70E, according to one example. The change in signal 70A-70E is a count value difference between an initialized reference count value for different levels of moisture present on the outer lens 24. As moisture in the form of condensation on the outer lens 24 or humidity proximate thereto increases, the moisture enters the activation field associated with the capacitive sensor and causes a disruption to the capacitance, thereby resulting in a raw signal increase as shown by signals 70B-70E. Signal 70A represents a clean lens having little or no moisture in which the signal 70A is relatively low and steady. Signal 70B shows the signal when sensing ice on the outside surface of the outer lens 24 which has a relatively high signal output. Signal 70C shows the results of condensation formed on the outer lens 24. Signal 70D shows the effect of rain on the outer surface of the outer lens 24. Signal 70E shows a defogging signal pattern that shows the removal of moisture during the heater operation. By monitoring the signal generated by the capacitive sensor and comparing the signal to known moisture values, the condensation or humidity can be sensed and used to control the heater to remove the condensation from the outer lens 24.

Figure 8:
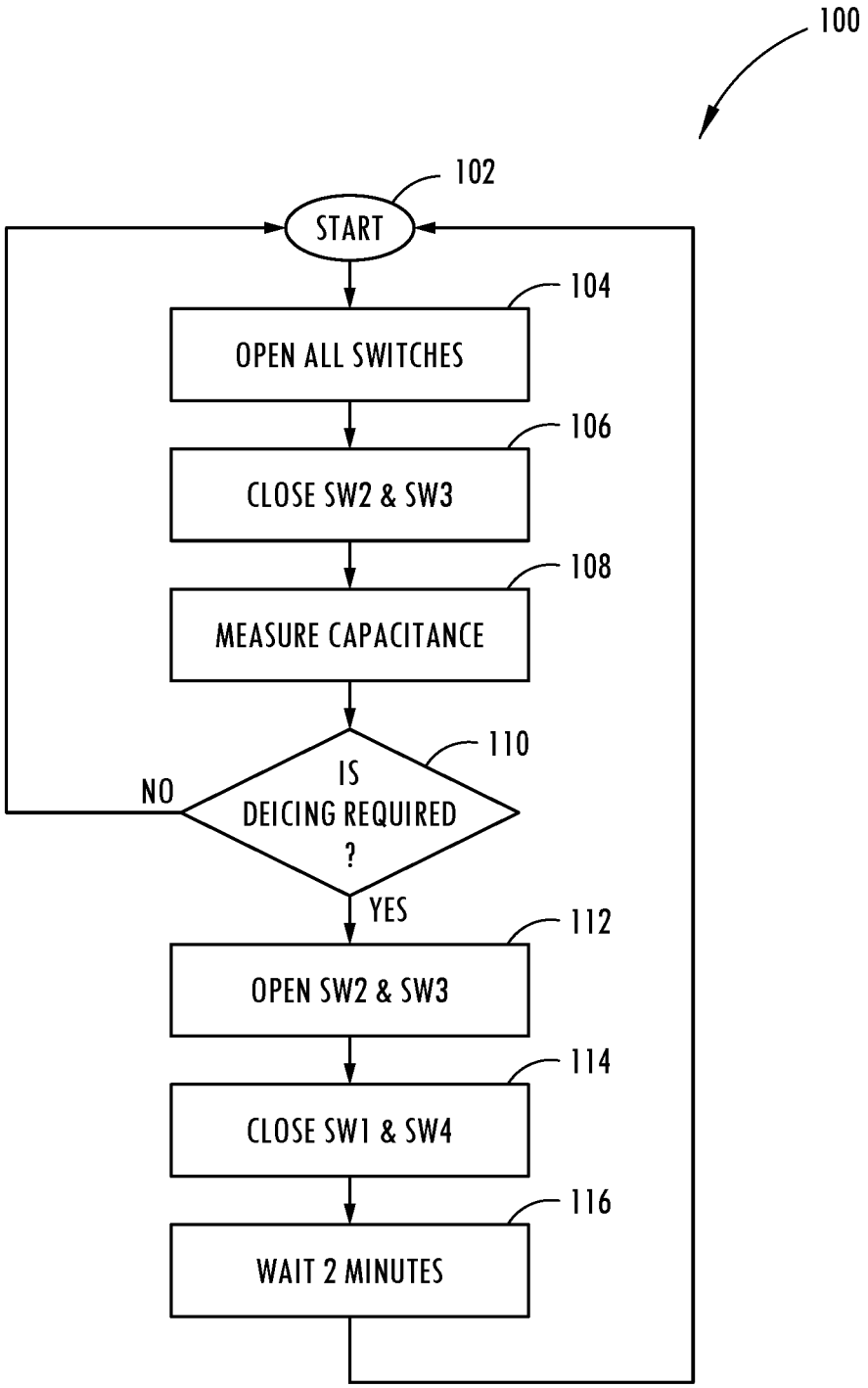
FIG. 8 is a flow diagram illustrating a routine for controlling the switching between the capacitive sensor and heater, according to one embodiment.

Referring to FIG. 8, routine 100 is illustrated for controlling the switches to switch operation of the conductive circuitry 40 between the capacitive sensing operation mode and the heater operation mode, according to one embodiment. Routine 100 begins at step 102 and proceeds to step 104 to open all switches SW1-SW4. Next, at step 106, the second and third switches SW2 and SW3 are closed. This places the conductive circuitry 40 into the capacitive sensor mode of operation. The capacitance is then measured at step 108. Proceeding to step 110, routine 100 determines if de-icing is required based on the measured capacitance indicating that moisture has built up on the outer lens. De-icing may be required when there is sufficient condensation on the inside or outside of the lens or snow or ice on the outside of the lens. If de-icing is not required, routine 100 returns to step 102. If de-icing is required, routine 100 proceeds to step 112 to open the second and third switches SW2 and SW3 and then to step 114 to close the first and fourth switches SW1 and SW4. This places the conductive circuitry 40 into the heater mode of operation. At this point, the heater operates to heat the outer lens 24 to remove some or all of the moisture from the outer lens 24. Routine 100 proceeds to step 116 to wait for a time period, such as two minutes to operate the heater before returning to step 102. It should be appreciated that routine 100 may be repeated to cycle the conductive circuitry 40 between the capacitive sensing and heater modes of operation.

Accordingly, the vehicle light assembly 20 advantageously employs conductive circuitry 40 provided on the lens 24 for forming a capacitive sensor for sensing moisture on the lens and a heater for heating the lens to remove the moisture. It should be appreciated that the conductive circuitry 40 advantageously integrates both the capacitive sensing and the heater element into a common circuitry that allows for multiple functions with less components.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A vehicle light assembly comprising: a light source;
a lens in front of the light source;
conductive circuitry provided on a surface of the lens and forming a capacitive sensor for sensing moisture on the lens and a heater for removing the moisture; and
a controller selectively controlling energization of one of the capacitive sensor and the heater, wherein the conductive circuitry comprises a first electrode comprising a first plurality of electrode fingers on the surface of the lens, a second electrode comprising a second plurality of electrode fingers on the surface of the lens, overlapping regions of the first and second pluralities of fingers, and a dielectric layer layered between and disposed to isolate the overlapping regions of the first and second pluralities of electrode fingers.

2. The vehicle light assembly of claim 1, wherein the conductive circuitry forming the capacitive sensor also serves as the heater.

3. The vehicle light assembly of claim 1 further comprising switching circuitry for selectively switching operation of the conductive circuitry between the capacitive sensor and the heater.

4. The vehicle light assembly of claim 3, wherein the controller controls the switching circuitry to switch operation of the conductive circuitry between the capacitive sensor and the heater.

5. The vehicle light assembly of claim 1, wherein the light assembly forms a vehicle headlight.

6. The vehicle light assembly of claim 1, wherein the light assembly forms a vehicle rear taillight.

7. The vehicle light assembly of claim 1, wherein the conductive circuitry comprises an optically transparent conductive material.

8. The vehicle light assembly of claim 7, wherein the visually transparent conductive medium comprises indium tin oxide.

9. The vehicle light assembly of claim 1, wherein the capacitive sensor comprises the first electrode comprising the first plurality of electrode fingers and the second electrode comprising the second plurality of electrode fingers, and wherein the first plurality of electrode fingers are interdigitated with the second plurality of electrode fingers.

10. The vehicle light assembly of claim 1, wherein the heater operates as a resistive heater that generates heat based on electric current.

11. The vehicle light assembly of claim 1, wherein the conductive circuitry comprises at least one electrode that generates a capacitive signal for the capacitive sensor and generates heat for the heater.

12. A vehicle light assembly comprising: a light source;
a lens in front of the light source;
conductive circuitry provided on a surface of the lens and forming a capacitive sensor having at least one electrode for sensing moisture on the lens and a heater for removing the moisture;
switching circuitry for selectively energizing one of the capacitive sensor and the heater; and
a controller controlling the switching circuitry to switch between the capacitive sensor and the heater, wherein the conductive circuitry comprises a first electrode comprising a first plurality of electrode fingers on the surface of the lens, a second electrode comprising a second plurality of electrode fingers on the surface of the leas, overlapping regions of the first and second pluralities of fingers, and a dielectric layer layered between and disposed to isolate the overlapping regions of the first and second pluralities of electrode fingers.

13. The vehicle light assembly of claim 12, wherein the light assembly forms a vehicle headlight.

14. The vehicle light assembly of claim 12, wherein the light assembly forms a vehicle rear taillight.

15. The vehicle light assembly of claim 12, wherein the conductive circuitry comprises an optically transparent conductive material.

16. The vehicle light assembly of claim 12, wherein the capacitive sensor comprises the first electrode comprising the first plurality of electrode fingers and the second electrode comprising the second plurality of electrode fingers, wherein the first plurality of electrode fingers are interdigitated with the second plurality of electrode fingers.

17. The vehicle light assembly of claim 12, wherein the heater operates as a resistive heater that generates heat based on electric current.

18. The vehicle light assembly of claim 12, wherein the at least one electrode forms the capacitive sensor and the heater.

19. A vehicle light assembly comprising:
a light source;
a lens in front of the light source;

conductive circuitry provided on a surface of the lens and forming a capacitive sensor for sensing moisture on the lens and a heater for removing the moisture, wherein the conductive circuitry has at least one electrode that generates a capacitive signal in a sensing operation and generates heat in a heater operation;

switching circuitry for selectively energizing one of the capacitive sensor and the heater; and a controller controlling the switching circuitry, wherein the conductive circuitry comprises a first electrode comprising a first plurality of electrode fingers on the surface of the lens, a second electrode comprising a second plurality of electrode fingers on the surface of the lens, overlapping regions of the first and second pluralities of fingers, and a dielectric layer layered between and disposed to isolate the overlapping regions of the first and second pluralities of electrode fingers.

* * * * *